United States Patent [19]

Nakazato et al.

[11] 4,208,199

[45] Jun. 17, 1980

[54] PROCESS OF AND SYSTEM FOR LIQUEFYING AIR TO SEPARATE ITS COMPONENT

[75] Inventors: Norio Nakazato; Norihide Saho; Sachihiro Yoshimatsu; Michimasa Okabe, all of Kudamatsu, Japan

[73] Assignee: Hitachi, Ltd., Tokyo, Japan

[21] Appl. No.: 951,974

[22] Filed: Oct. 16, 1978

Related U.S. Application Data

[63] Continuation-in-part of Ser. No. 821,199, Aug. 2, 1977, abandoned.

[30] Foreign Application Priority Data

Aug. 11, 1976 [JP] Japan ..... 51-94795

[51] Int. Cl.[2] ..... F15J 3/04

[52] U.S. Cl. ..... 62/29; 62/38

[58] Field of Search ..... 62/29, 13–15, 62/38, 39

[56] References Cited

U.S. PATENT DOCUMENTS

| | | | |
|---|---|---|---|
| 2,753,698 | 7/1956 | Jakob | 62/29 |
| 2,802,349 | 8/1957 | Skaperdas | 62/29 |
| 2,850,880 | 9/1958 | Jakob | 62/29 |
| 3,327,489 | 6/1967 | Gaumer, Jr. | 62/29 |
| 3,348,385 | 10/1967 | Kamlani et al. | 62/29 |

*Primary Examiner*—Norman Yudkoff

*Attorney, Agent, or Firm*—Thomas E. Beall, Jr.

[57] ABSTRACT

In a process of and a system for liquefying air to separate its components employing a so-called compound fractionating column, the system includes a fractionating medium pressure column into which a part of feed air is introduced to flow therethrough as an upwardly flowing gas for contact with a returning liquid, so as to obtain nitrogen gas at the top thereof and change the returning liquid to liquefied air as it reaches the bottom thereof, a first condenser adapted for a heat exchange between a liquefied air of a reduced pressure, which has been obtained by allowing an expansion of the liquefied air available at the bottom of the medium pressure column, and the nitrogen gas obtained at the top of the medium pressure column, so as to liquefy the nitrogen gas to make use of it as the returning liquid for the medium pressure column, a second condenser adapted for a heat exchange between the remainder part of feed air and liquefied oxygen to evaporate the oxygen, and a fractionating low pressure column through which the evaporated oxygen is made to flow as an upwardly flowing gas adapted to be contacted by a returning liquid coming down from the top of the low pressure column for a fractionation, whereby an impure gas is obtained at the top of the low pressure column, while the returning liquid is changed to liquefied oxygen as it reaches the bottom of the low pressure column.

5 Claims, 6 Drawing Figures

PROCESS OF AND SYSTEM FOR LIQUEFYING AIR TO SEPARATE ITS COMPONENT

CROSS-REFERENCE TO THE RELATED APPLICATION

This is a continuation-in-part application of U.S. Ser. No. 821,199 filed on Aug. 2, 1977, now abandoned.

LIST OF PRIOR ART REFERENCES

The following references are cited to show the state of the art:

Japanese Patent Publication No. Sho. 50-39626 Keio Nakago Dec. 13, 1963.

BACKGROUND OF THE INVENTION

The present invention relates to a process of and a system for liquefying air for separating components thereof and, more particularly, to a process and system for the above stated purpose employing a compound fractionating column for allowing the separation at a relatively low pressure.

Nowadays, systems are used in various fields of industry, for liquefying air to separate nitrogen, oxygen, argon and other components. These systems employ, in order to facilitate the liquefaction, compressors for compressing the feed air. These compressors consume very large driving power and, accordingly, cost a great deal. It is not too much to say that the operation cost for the air compressor is the cost for operating the whole system.

Especially, in the systems for fractionating air, which are usually of large scale and capacity, the problem of this operation cost is correspondingly serious, and for this reason, they are keen to reduce the operation cost of the system.

It has been recognized that the power cost for an air compressor is mterially in proportion to the delivery pressure of the compressor, i.e. the pressure of the feed air. Therefore, the power cost for the air-liquefaction plant can be reduced by lowering the pressure of the feed air.

In order to separate oxygen of high purity from the compressed and cooled material air, it is necessary to use a so-called compound fractionating column having a medium pressure column for performing a primary fractionation of the feed air and a low pressure column for effecting a subsequent secondary fractionation.

In general, for obtaining a satisfactory operation of the compound fractionating column, it is indispensable that upward flow of gas and returning liquid are maintained in the medium pressure and low pressure columns, since the fractionation is caused by gas-liquid contact of the upwardly flowing gas and the returning liquid on a plurality of stages of plate.

Thus, the conventional techniques can be sorted into two types by the ways for obtaining the upward flow of gas and the returning liquid flow in the low pressure and medium pressure columns.

To explain the technique of the first type, the feed air in gaseous phase (this may be partially liquefied in the preceding process) is introduced into a medium pressure column through the bottom of the latter to form an upward flow of gas therethrough. The gas makes contact with returning liquid on the stages of plates as it flows upwardly to be fractionated, and becomes nitrogen gas of a considerable purity when it reaches the top of the medium pressure column. Meanwhile, liquefied oxygen of a high purity is obtained at the bottom of the low pressure column. The liquefied oxygen available at the bottom of the low pressure column and the nitrogen gas obtained at the top of the medium pressure column are brought into a condenser for a heat exchange therebetween, to condense the nitrogen gas and to evaporate the oxygen. The condensate of the nitrogen is used as the returning liquid in the medium pressure column. At the same time, a part of the condensate is introduced, through a pipe having an expansion valve, to the top of the low pressure column to be used as the returning liquid through the low pressure column.

The evaporated oxygen at the bottom of the low pressure column then flows upwardly through the low pressure column as the upward flow of gas. The oxygen makes contact, in the course of the flow to the top of the column, with the returning liquid on the stages of plate. Consequently, a gas rich in nitrogen, i.e. a nitrogen gas of not so high purity, is obtained at the top of the low pressure column. Thus, the gas rich in nitrogen is picked out from the top of the column, while the returning liquid reached the bottom of the column in the form of liquified oxygen of high purity is taken out as the industrial product.

Thus, the technique of method of the first type depends on a heat exchange between the liquefied oxygen obtained at the bottom of the low pressure column and the nitrogen gas obtained at the top of the medium pressure column. In order that this heat exchange is performed satisfactorily, it is necessary to maintain a pressure in the medium pressure column high than that in the low pressure column, so as to make the saturating temperature of the nitrogen gas at the top of the medium pressure column higher than the saturating temperature of the liquefied oxygen at the bottom of the low pressure column.

In general, the pressure in the low pressure column is about 1.3 $Kg/cm^2$, while the temperature difference between two phases in the condenser is about 2° K. Therefore, the temperatures of the liquefied oxygen and the nitrogen gas are typically 92° K. and 94° K., respectively. Consequently, the medium pressure column must be maintained at a high pressure of about 5.2 $Kg/cm^2$. Thus, the pressure of the feed air is substantially same to that of the medium pressure tower.

This means that the method of the first type in which the pressure of the feed air is high is unacceptable due to the high power cost.

In order to avoid the above described inconvenience, the method of second type has been proposed as follows.

The feed air is devided into two volumes, one of which is introduced into a condenser provided at the bottom of the low pressure column, for a heat exchange with the liquefied oxygen available thereat. The condensate air is then introduced into a middle section of the medium pressure column. The oxygen evaporated in the condenser is then used as the upward flow of gas through the low pressure column. Meanwhile, the remainder part of the feed air is introduced to the bottom of the medium pressure column to be used as the upward flow of gas therethrough.

The returning liquids for the medium pressure and low pressure columns are obtained in accordance with the following measure. Namely, at first a liquefied gas having a boiling point lower than that of the liquefied oxygen at the bottom of the low pressure column is prepared at the outside of the apparatus. The gas is introduced to a condenser provided at the top of the medium pressure column, for a heat exchange with the nitrogen gas at the top of the medium pressure tower. Consequently, the nitrogen is condensated to liquid phase, a part of which is used as the returning liquid through the medium pressure column while the remainder is introduced to the top of the low pressure column to flow therethrough as the returning liquid. The liquefied gas is evaporated as a result of the heat exchange at the condenser and is extracted out of the system.

According to this method of the second type, the pressure of the nitrogen gas at the top of the medium pressure column, i.e. the pressure of the feed air can be determined by the boiling point of the liquefied gas separately prepared externally of the system. Supposing here that liquefied oxygen opened to atmospheric is used as the liquefied gas for the heat exchange, the temperature of the nitrogen gas at the top of the medium pressure column may be 92° K., since the boiling point of liquefied oxygen under atmospheric pressure is 90° K., so that pressure at the top of the medium pressure tower, i.e. the pressure of the feed air can be as low as about 4 $Kg/cm^2$.

Althogh the method of the second type can make use of the material air of a pressure reduced by about 1 $Kg/cm^2$ as compared with that of the first type method, it suffers from the following problems because of the separate preparation of the heat exchanging liquefied gas externally of the system.

The first problem resides in that the system necessitates the heat exchanging gas which is to be liquefied by another independent system. It is of course possible to make use of the oxygen liquefied at the bottom of the low pressure column as the heat exchanging liquefied gas. However, such a measure would cause a shortage of the cold heat source, resulting in a deterioration of the smooth operation of the system, when an excessively large amount of liquefied oxygen is extracted for the purpose of above stated heat exchange.

There exists a practical lower limit for the amount of the liquefied oxygen condensate at the top of the medium pressure tower, for an efficient separation and recovery of the pure oxygen from the feed air.

For instance, even when the feed air is perfectly fractionated, i.e. by 100%, the amount of oxygen collected at the bottom of the low pressure column is 21% with respect to the amount of the feed air. The amount of the cold heat source for condensing the nitrogen at the top of the medium pressure column by an amount sufficiently large to provide enough returning liquids for both columns usually exceeds the cold heat discharged from the liquid oxygen the amount of which is 21% of the feed air at the largest.

Therefore, for obtaining a smooth operation of the compound fractionating column, it is necessary to prepare a liquefied gas produced in a separate system, is addition to the liquefied oxygen produced in the system in question itself, for use as a cold source.

In addition, when the oxygen product must be taken out in the liquid phase, the amount of liquefied oxygen available for the heat exchange gets smaller accordingly. Thus, a larger amount of liquefied gas must be prepared in the separate system.

The second problem resides in that the continuous operation of the liquefaction system for the air is rendered unstable. As is well known, a considerably long time is required for starting the system. Once the system is started, it is operated continuously for a half year or longer, for maintaining the loss of cold energy and other reasons. Therefore, the liquefied gas for the heat exchange must be always prepared over the long period of operation of the system. It involves various problems to rely this continuous preparation of the liquefied gas upon the separate system. Consequently, the stable operation of the system is often failed.

The third problem resides in that the air fractionating system becomes unacceptably complicated. Since a separate system is required for preparing the liquefied gas for the purpose of the heat exchange, transportation and storage equipments must be employed additionally, to make the fractionating system as a whole complicated. In addition, the additional provision of the transportation and storage equipments inevitably increases the loss of cold energy.

Thus, in the conventional refractionating method of the second type, the advantage over the method of the first type brought about by the reduced power cost is negative by the disadvantage attributable to the necessity of the additional liquefied gas and the separate system for preparing the additional liquefied gas.

Under these circumstances, the present invention aims at providing an improved process of and system for liquefying air and separating its components, at a reduced power cost and without necessitating the additional separate system.

According to the first aspect of the invention, there is provided a process in which feed air which has been compressed by an air compressor and cooled by a heat exchanger is divided into three portions and a first portion of the feed air is supplied through an expansion turbine to a low pressure column, while a second portion of the feed air is introduced to a medium pressure column and is utilized as the upward flowing gas in the medium pressure column which is brought into contact with returning liquid obtained in a first condenser, so that nitrogen gas is obtained at the top of the medium pressure column. Meanwhile, the returning liquid is changed into liquefied air as it reaches the bottom of the medium pressure column. At the same time, a third portion of the feed air is introduced into a second condenser for a heat exchange with liquefied oxygen available at the bottom of the low pressure column, so as to evaporate the oxygen. The resulted oxygen gas then flows through the low pressure column upwardly contacting the returning liquid falling down from the top of the column, and is taken out from the system, as an impure gas, from the top of the low pressure column, while the returning liquid is changed into liquefied oxygen as it travels downwardly to the bottom of the low pressure column. The process of the invention is characterized, further to the above stated features, by a fact that the liquefied air at the bottom of the medium pressure column is expanded to have its pressure reduced to a low pressure level substantially equal to the pressure level in the low pressure column and introduced into the first condenser, and the expanded liquefied air of low pressure is subjected to heat exchange with the nitrogen gas at the top of the medium pressure column, so that the liquefied air will be vaporized and the nitrogen gas will be condensed for making use of the latter as the returning liquid for the medium pressure column.

According to another aspect of the invention, there is provided a system for liquefying air to separate its components including a medium pressure column adapted to invite a second portion of the feed air divided into three portions to allow it to flow upwardly therethrough, for putting it into contact with downfalling returning liquid, so as to fractionate the feed air in the form of upward flow of gas, thereby to obtain nitrogen gas and liquefied air, at the top and bottom thereof, respectively, a first condenser adapted to perform a heat exchange between a liquefied air of reduced pressure obtained by expanding the liquefied air at the bottom of the medium pressure column to have its pressure reduced to a low pressure level substantially equal to the pressure level in a low pressure column and the nitrogen gas available at the top of said medium pressure column, thereby to condense the latter for use as the returning liquid for said medium pressure column, a second condenser for receiving a third portion of the feed air for effecting heat exchange between it and liquefied oxygen, so as to evaporate the oxygen, and a low pressure column in which an upward flow of gas constituted by the oxygen evaporated in said second condenser and the gaseous air obtained by vaporization in the first condenser and introduced into the low pressure column is fractionated through a content with a downfall returning liquid from the top of said low pressure column, and the portion of the liquefied air introduced into the low pressure column after being expanded to have its pressure reduced to a low pressure level substantially equal to the pressure level in the low pressure column so as to obtain an impure gas to be taken out from the top of said lower pressure column and change said returning liquid into liquefied oxygen as it travels downwardly to the bottom of said low pressure column.

These and other objects, as well as advantageous features of the invention will become clear from the following description of the preferred embodiment taken in conjunction with the attached drawings in which:

DESCRIPTION OF THE PREFERRED EMBODIMENT

Figure 1:
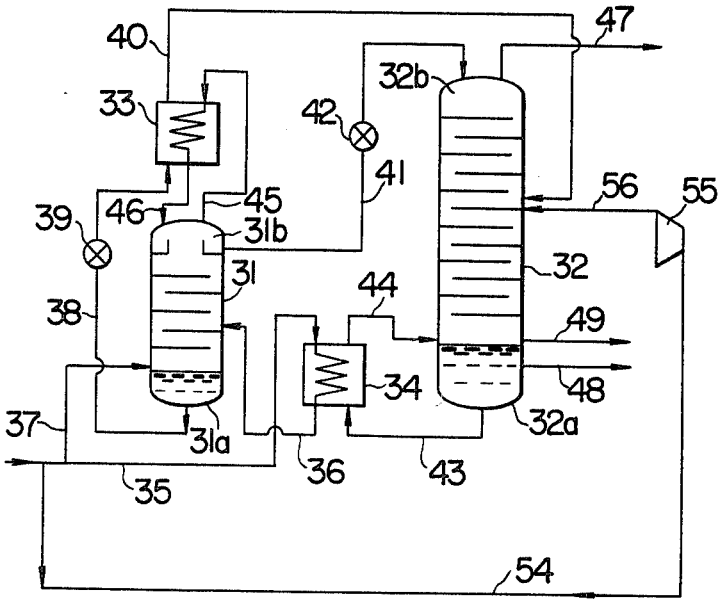
FIG. 1 is a flow sheet showing a process embodying the invention for liquefying air to separate its components.

Referring at first to FIG. 1 a preferred embodiment of the invention, a part of feed air is introduced, through a pipe 37, into a medium pressure column 31, to flow therethrough as an upward flow of gas. The gas is brought into contact, as it flows upwardly, with a downfalling returning liquid. Consequently, nitrogen gas is obtained at the top **31*b* of the medium pressure column, while the returning liquid is changed into liquefied air until it reaches the bottom 31*a* of the column 31**.

The liquefied air available at the bottom of the medium pressure column 31 is introduced through a pipe 38, which liquefied air is expanded, by an expansion valve 39 mounted in the pipe 38, and has its pressure reduced to a low pressure level substantially equal to the pressure level in a low pressure column 32, into a first condenser 33 which receives also the nitrogen gas from the top of the medium pressure column 31, through a pipe 45. As a result of the heat exchange carried out in the first condenser 33, the nitrogen gas is condensed into liquid phase to be used as the returning liquid through the medium pressure column, through a pipe 46. The other part of the feed air is introduced into a second condenser 34 through a pipe 35. The second condenser is adapted to receive also liquefied oxygen, through a pipe 43, from the bottom **32*a* of the low pressure column 32 mentioned latter. As a result of a heat exchange between the liquefied oxygen and the feed air, carried out in the second condenser 34, the oxygen is evaporated and the resultant gaseous oxygen is introduced to the bottom 32*a* of the low pressure column 32, through a pipe 44, while the condensate air is introduced, through a pipe 36, into the middle portion of the medium pressure column 31**.

The gaseous oxygen brought into the low pressure column 32 and the liquefied air vaporized into gaseous air in the first condenser 33 are made to flow upwardly therethrough to make contact with the returning liquid, which has been introduced from the upper portion of the medium pressure column 31 to the top **32*b* of the low pressure column 32, with its pressure decreased by an expansion valve 42 provided in a pipe 41 and a portion of the liquefied air obtained by expanding the liquefied air at the bottom of the medium pressure column 31 to have its pressure reduced to a low pressure level substantially equal to the pressure level in the low pressure column 32. Consequently, the gaseous oxygen is fractionated, so that an impure gas is taken out of the system from the top 32*b* of the low pressure column 32 through a pipe 47, while the returning liquid is changed into the bottom 32*a*** of the low pressure column.

55 designates an expansion turbine to which the feed air of high pressure is led through a pipe 54 and which expands the same to render its pressure substantially equal to the pressure in the low pressure column 32. The expansion turbine 55 supplies the expanded air of low pressure to the low pressure column 32 through a pipe 56 so as to generate the cold in the system for liquefying air to separate its components.

The operation of the system as constructed above will be described in detail hereinafter.

The feed air has been compressed by an air compressor and cooled by a heat exchanger of a preceding process, and is free of moisture and $CO_2$ gas. The feed air is divided into three portions. A first portion of the feed air is led to the expansion turbine 55 through the pipe 54, where the feed air is expanded to have its pressure reduced to a low pressure level substantially equal to the pressure level in the low pressure column 32. When the feed air of high pressure is expanded by the expansion turbine 55 into air of low pressure for supply to the low pressure column 32 through the pipe 56, the cold necessary for a system for liquefying air to separate its components is generated. A second portion of the feed air is introduced to the second condenser 34 through the pipe 35. A heat exchange is performed in the second condenser 34, between the feed air and the liquefied oxygen in the outer side of the second condenser 34, so that the liquefied oxygen is evaporated, while the feed air is condensed to become a liquefied air. The resulted liquefied air is introduced to the middle portion of the medium pressure column 31, through the pipe 36.

Meanwhile, a third portion of the feed air is delivered to the bottom **31*a* of the medium pressure column 31, through the pipe 37, to become the upwardly flowing gas through the column 31. The upward flow of gas is made to contact the downfall of the returning liquid which has been obtained in the first condenser 33, and is fractionated so that nitrogen of a high purity is collected at the top 31***b* of the medium pressure column 31, while the returning liquid is also fractionated to become liquefied air rich in oxygen and collected at the bottom 31*a* of the medium pressure column 31. Subsequently, the liquefied air is delivered, through the pipe 38, with its pressure being reduced to a pressure level substantially equal to the pressure level in the low pressure column 32 as it is expanded by the expansion valve 39, to the first condenser 33. The first condenser, which also receives the nitrogen gas from the top 31*b* of the medium pressure column 31, performs a heat exchange between the liquefied air of the reduced pressure and the nitrogen gas, so that the nitrogen is condensed, while the liquefied air is partially evaporated and introduced to the middle portion of the low pressure column 32, in a mixed phase condition, i.e. partly in the liquid phase and partly in the gaseous phase, through the pipe 40. The nitrogen gas at the top 31*b* of the medium pressure column 31 is introduced into the first condenser 33, through the pipe 45, and is condensed in the condenser, a part of the condensate of which is returned to the top 31*b* of the medium pressure column 31, to be utilized as the returning liquid through the medium pressure column. A part of this liquefied nitrogen is extracted from the medium pressure column 31, and is then delivered to the top 32*b* of the low pressure column 32, through the pipe 41. It will be seen that the pressure of this liquefied nitrogen is reduced as the nitrogen passes through the expansion valve 42 provided in the pipe 41, so as to be effectively used as the returning fluid through the low pressure column 32.

On the other hand, the liquefied oxygen at the bottom 32*a* of the low pressure column 32 is sent to the second condenser 34, through the pipe 43, to be evaporated thereat. The resultant evaporated oxygen in the gas phase is then introduced into the bottom 32*a* of the low pressure column 32, through the pipe 44, and is made to flow through the column 32 upwardly to be brought into contact with the returning fluid coming down from the top 32*b* of the column 32. Consequently, the oxygen gas is changed to an impure nitrogen gas rich in nitrogen, as it reaches the top 32*b* of the low pressure column 32, and is extracted therefrom through a pipe 47, while the returning liquid is changed into liquefied oxygen of a high purity during its travel down to the bottom 32*b* of the low pressure column 32.

When it is desired to extract the oxygen as the industrial product in the liquid phase, the liquefied oxygen at the bottom 32*a* of the low pressure column 32 is taken out through the pipe 48, while, when the product oxygen must be in the form of gas, the oxygen gas just upper the liquefied oxygen is taken out through the pipe 49.

As will be seen from the foregoing description, according to the first embodiment of the invention, the nitrogen gas collected at the top of the medium pressure column can conveniently be condensed by the liquefied air obtained in the medium pressure column itself and having a reduced pressure, overcoming the problems inherent in the conventional techniques.

More specifically, it becomes unnecessary to prepare additional or independent liquefied gas as the cold heat source which has had to be produced conventionally by means of separate system, and the pressure of the feed air can be made lower, contributing greatly to reduce the power cost. For the second point, it becomes possible to extract the product oxygen in the liquid phase, without substantial difficulty. For the third point, the air liquefying plant can be operated continuously and stably. Further, for the fourth point, the system as a whole can be much simplified, because transportation and storage equipments, which have been necessary in the conventional arrangement, can fairly be dispensed with.

A result of a series of tests conducted by the present inventors, for confirming the advantageous effect of the invention, will be described hereinafter with reference to FIGS. 2 and 3.

Figure 2:
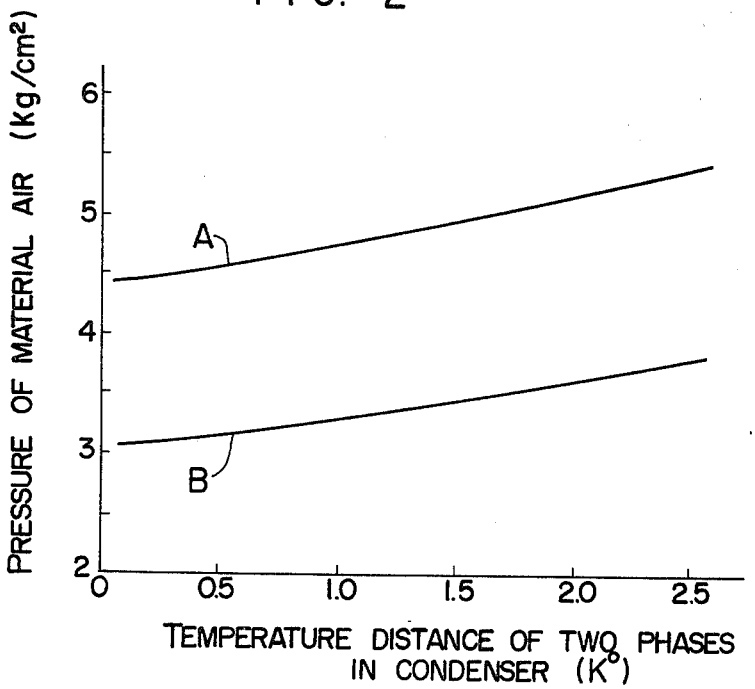
FIGS. 2 and 3 are graphical representations of relationships between the pressure of feed air and temperature difference of two phases in condenser, showing results of tests conducted by the present inventors for confirming the advantages of the invention.

Referring at first to FIG. 2, the pressure of the feed air in accordance with the first type conventional method, i.e. the method in which a heat exchange is made between the liquid oxygen at the bottom of the low pressure column and the nitrogen gas at the top of the medium pressure column, is shown by a curve A, while a curve denoted by B represents the pressure of the feed air in accordance with the method of the invention, i.e. the method in which the heat exchange is made between the gaseous feed air and the liquefied oxygen at the bottom of the low pressure column. The test was conducted under a condition in which the pressure of the low pressure column was 1.3 $Kg/cm^2$ and the temperature at the bottom of the same column was made 92.3° K.

The pressure of the feed air increases as the temperature difference in the condenser gets large, commonly for the methods of prior art and the present invention. However, the feed air pressure in accordance with the method of the invention is as low as about 3.6 $Kg/cm^2$, provided that the temperature difference in the condenser is 2° K., while, accordance to the conventional method, the feed air pressure is as high as 5.2 $Kg/cm^2$ for the same temperature differential. Thus, according to the invention, the feed air pressure is reduced by about 1.6 $Kg/cm^2$, which greatly contribute to reduce the power cost of the air liquefying system.

Figure 3:
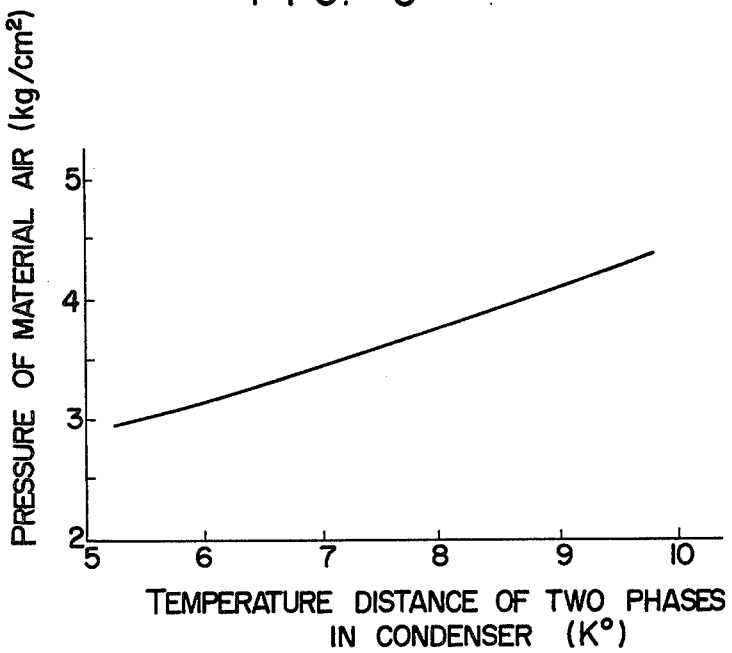

FIG. 3 shows the pressure of the feed air in accordance with the method of the invention in which the nitrogen gas at the top of the medium pressure column is brought into heat exchange with the liquefied air obtained at the bottom of the medium pressure column and expanded to a lower pressure by the expansion valve. The pressure of the feed air is increased substantially in proportion to the temperature differential. Supporting here that the pressure and the temperature of the liquefied air are 1.3 $Kg/cm^2$ and 82.3° K. respectively, after the expansion, and that the density of the oxygen in the liquefied air is 40 vol %, respectively, the feed air pressure is about 3.6 $kg/cm^2$, when the temperature differential in FIG. 2 is 2° K. Therefore, for the feed air pressure of 3.6 $kg/cm^2$, the temperature differential in FIG. 3 can be about 7.5° K.

The heat exchange between the liquefied air under the pressure of the medium pressure column and the nitrogen gas at the top of the medium pressure column could not be established due to the negative temperature differential.

However, according to the invention, the heat exchange between the liquefied air and the nitrogen gas can fairly be accomplished, due to the pressure reduction of the liquefied air through the expansion. In addition, the temperature differential available for the heat exchange is as high as about 7.5° K., which affords a considerably large allowance for the design. Thus, according to the invention, the amount of a cold source energy sufficient to liquefy the nitrogen gas available at the top of the medium pressure column can fairly be preserved.

Figure 4:
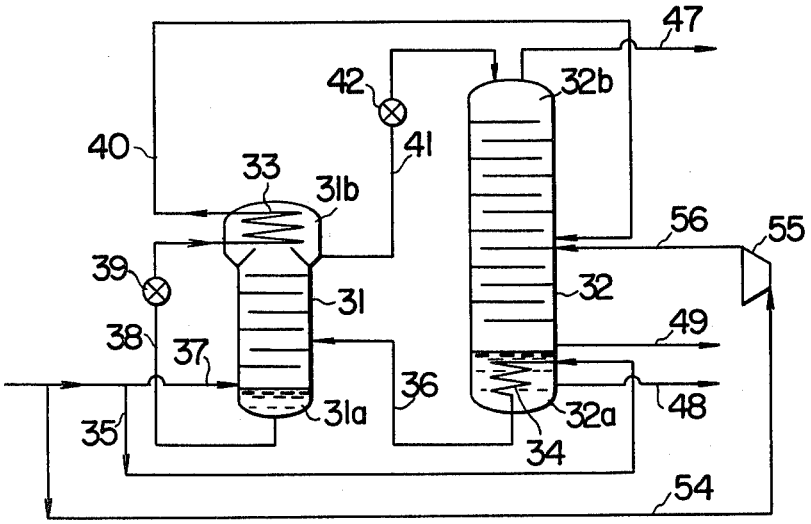
FIGS. 4, 5 and 6 are flow sheets of different embodiments of the invention.

Referring now to the second embodiment of the invention as shown in FIG. 4, the first condenser 33 is incorporated in the medium pressure column 31 at the top 31*b* of the latter, while the second condenser 34 is built in the low pressure column 32 at the bottom 32*a* of the latter. Thus, according to the second embodiment of the invention, the condensers are conveniently accomodated by respective columns, so that an advantage is brought about, in addition to those stated above, that the compound fractionating column can be much simplified with less pipes employed. Further, since the fluids are kept free from the external influences, the radiation of a cold is decreased correspondingly.

Figure 5:
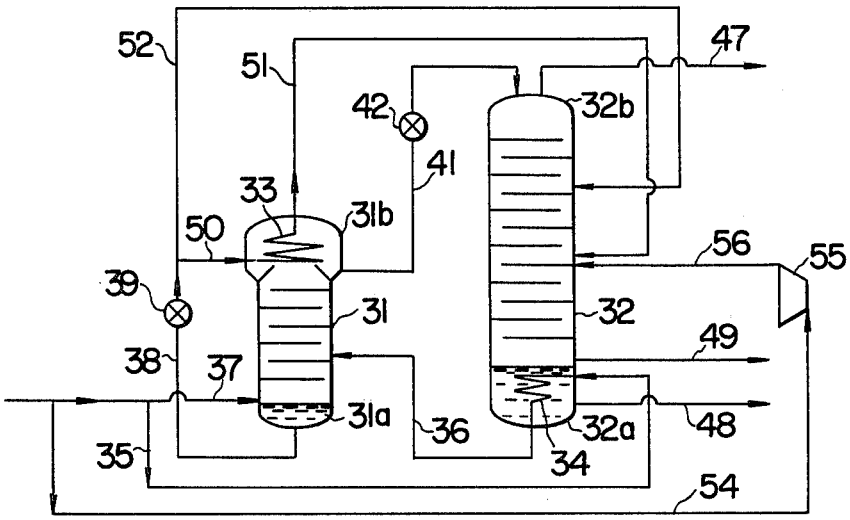

Referring now to FIG. 5 showing the third embodiment of the invention, the liquefied air from the bottom 31*a* of the medium pressure column 31 is separated into two volumes, after it has passed the expansion valve 39, one of which is delivered to the first condenser 33 provided at the top 31*b* of the medium pressure column 31, through a pipe 50, for a heat exchange with the nitrogen gas at the top 31*b* of the medium pressure column. The whole part of the liquefied air introduced into the first condenser 33 is evaporated and is then delivered to the middle portion of the low pressure column 32 through a pipe 51. Meanwhile, the remainder part of the liquefied air separated after having passed the expansion valve is then delivered through pipe 52, in the liquid phase, into the low pressure column 32, at a portion of the latter above the point to which the pipe 51 is connected.

The point at which the pipe 51 is connected to the low pressure column is so selected that the densities of oxygen of the gaseous air and that of the gas upwardly flowing through the column are equal to each other at that point. On the other hand, the point at which the liquid air supplying pipe 52 is connected to the column 32 is so selected that the densities of oxygen of the liquefied air and that of the returning liquid are equal to each other at the point.

It will be seen that this arrangement affords an advantage, in addition to those described, that the number of stages of plate can be reduced to shorten the height of the column, because the fractionating function is not hindered, thanks to the supply of the gaseous and liquefied airs to respective optimum positions of the column, independently from each other.

Figure 6:
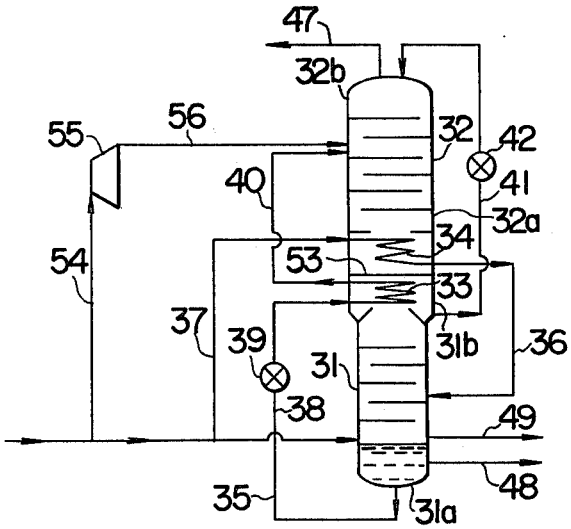

Referring to FIG. 6 showing a fourth embodiment of the invention, the medium pressure and the low pressure columns 31 and 32 are superimposed, being separated by a partition wall 53, materially assuming the form of a single column or tower. This naturally leads to an advantage of reduced installation area, preserving the above stated advantages of the invention.

In the foregoing description, the liquid at the bottom of the medium pressure column, the gas residing in the top area of the medium pressure column, the liquid made by a condensation of the gas and the liquid at the bottom of the low pressure column are explained to be liquefied air, nitrogen gas, liquefied nitrogen and liquefied oxygen, respectively. However, it is to be noted that these representations are employed to mean that the respective gases and liquids have compositions close to those of the liquefied air, nitrogen gas, liquefied nitrogen and liquefied oxygen, respectively, as are used usually in the field of technique concerned. For example, the liquid available at the medium pressure column includes 25 to 45% of oxygen, but can still be referred to as "liquefied air", as will be accepted by those skilled in the art. Thus, it is to be noted that when the gases and liquids are not the described ones in a strict sense, the system employing these gases and liquids is fairly involved by the scope of the invention, as far as the positional relationship of these gases and liquids is equivalent to those of the described embodiments.

Although the two condensers have been described to be built-in in respective columns, it will be seen that the same advantage can be brought about even if they are situated externally of the columns.

As has been described, according to the invention, there is provided a system comprising a medium pressure column into which a part of feed air is introduced to flow upwardly therethrough for contacting with a returning liquid thereby to be fractionated, so as to produce nitrogen gas at the top of said medium pressure column and to turn the returning liquid to liquefied air at the bottom of said column, a first condenser adapted to cause a heat exchange between the liquefied air, which has been introduced from the bottom of said medium pressure column and expanded to a lower pressure as it passed an expansion valve, and the nitrogen gas at the top of said medium pressure column, thereby to condense the nitrogen gas to make use of it as the returning liquid for said medium pressure column, a second condenser to which the remainder feed air is introduced for a heat exchange with liquefied oxygen to evaporate said oxygen to gaseous phase, and a low pressure column in which gaseous oxygen obtained by vaporization of the liquefied oxygen and gaseous air obtained by vaporization in the first condenser constitute upwardly flowing gases which are brought into gas-to-liquid contact with a returning liquid from the top of the column and a part of the liquefied air obtained by expanding the liquefied air at the bottom of the medium pressure column, so that fractionating will be carried out and impure gases are taken out through the top of the column while the returning liquid is converted into liquefied oxygen at the bottom of the column.

According to another aspect of the invention, there is provided a method making use of the above stated system characterized in that the liquefied air delivered from the bottom of the medium pressure column and expanded to a lower pressure and the nitrogen collected at the top of the medium pressure column are introduced into the first condenser for a heat exchange therebetween, so as to condense the nitrogen gas into liquidus phase, thereby to make use the liquefied nitrogen as the returning liquid through the medium pressure column. Thus, according to the invention, the nitrogen gas obtained at the top of the medium pressure column can conveniently be condensed by means of the liquefied air obtained by the medium pressure column itself and then expanded to a lower pressure.

Therefore, it becomes unnecessary to use additional or separate system for providing the cold source, and, in addition, the power cost is greatly reduced thanks to the reduced feed air pressure afforded by the invention.

Having described the invention through specific embodiments, it is to be noted here that various changes and modifications may be imparted thereto without departing from the scope of the invention which is delimited solely by the appended claims.

What is claimed is:

1. A process for liquefying air to separate its ccomponents comprising:

dividing feed air, compressed by a compressor and cooled by a heat exchanger, into three portions;

supplying a first portion of the feed air to a low pressure column by way of an expansion turbine;

supplying a second portion of the feed air to a medium pressure column to use it as an upwardly flowing gas which is brought into gas-to-liquid contact with a returning liquid obtained in a first condenser so as to fractionate said upwardly flowing gas to obtained nitrogen gas at the top of the medium pressure column and to convert said returning liquid into liquefied air at the bottom of the medium pressure column;

supplying a third portion of the feed air to a second condenser where the feed air is subjected to heat exchange with liquefied oxygen from the low pressure column to vaporize said liquefied oxygen to obtain gaseous oxygen which is used as an upwardly flowing gas in the low pressure column brought into gas-to-liquid contact with a returning liquid from the top of the low pressure column to fractionate the gas so that the upwardly flowing gas will be taken out as an impure gas from the top of the low pressure column while the returning liquid will be converted into liquefied oxygen at the bottom of the low pressure column;

expanding said liquefied air at the bottom of said medium pressure column to reduce its pressure to a low pressure level substantially equal to the pressure level in said low pressure column;

introducing said expanded liquefied air of said low pressure level to said first condenser to subject the same to heat exchange with the nitrogen gas obtained at the top of said medium pressure column, so that a part of the liquefied air can be vaporized and at the same time said nitrogen gas can be condensed for use as the returning liquid in said medium pressure column; and introducing said partly vaporized liquefied air, after its heat exchange in said first condenser, into said low pressure column without any further substantial pressure reduction.

2. A prodess for liquefying air to separate its components as claimed in claim 1, wherein the liquefied air of low pressure obtained by expanding the liquefied air at the bottom of said medium pressure column to reduce its pressure to a low pressure level substantially equal to the pressure level in said low pressure column is divided into two portions, one portion being introduced into said first condenser where it is subjected to heat exchange with the nitrogen gas from the top of said medium pressure column so that it will be vaporized into gaseous air which is led to an intermediate portion of said low pressure column, and the other portion being directly led to said low pressure column, the latter portion being introduced into said low pressure column in a position located at a higher level than the position in which said gaseous air is introduced into the intermediate portion of said low pressure column.

3. A system for liquefying air to separate its components, comprising: means providing compressed compressed feed air divided into three portions;

a medium pressure column means receiving a supply of a second portion of the feed air to use it as an upwardly flowing gas which is brought into gas-to-liquid contact with a returning liquid to fractionate the feed air to obtain nitrogen gas at the top of the column and to convert the returning liquid into liquid air at the bottom of the column;

low pressure column means for maintaining a pressure lower than said medium pressure column means, and having liquid oxygen in its bottom;

means expanding said liquefied air at the bottom of said medium pressure column means to a low pressure level substantially equal to the pressure level in said low pressure column means;

first condenser means for causing heat exchange between said expanded liquefied air at said low pressure level and said nitrogen gas at the top of said medium pressure column means for condensing said nitrogen gas to obtain said returning liquid flowing through said medium pressure column;

second condenser means receiving a supply of a third portion of the feed air to subject the same to heat exchange with said liquefied oxygen in the bottom of said low pressure column means to cause the liquefied oxygen to vaporize; an expansion turbine; and means supplying a first portion of the feed air through said expansion turbine, gaseous oxygen obtained by the vaporization of said liquefied oxygen in said second condenser means and gaseous air obtained by vaporization in said first condenser means as an upwardly flowing gas in said low pressure column means to be brought into gas-to-liquid contact with a returning liquid from the top of the column and a liquid part of the liquefied air of low pressure obtained by expanding the liquefied air at the bottom of said medium pressure column to have its pressure reduced to a low pressure level substantially equal to the pressure level in the low pressure column means, whereby the upwardly flowing gas can be fractionated so as to take out impure gas through the top of the column and to convert said returning liquid into liquefied oxygen at the bottom of the column.

4. A system as claimed in claim 3, wherein said first condenser means is built in the top of said medium pressure column means, while said second condenser means is built in the bottom of said low pressure column means.

5. A system as claimed in claim 4, wherein said low pressure column means is installed above said medium pressure column means unitarily with the latter.

* * * * *